US005797665A

United States Patent [19]

Jeter

[11] Patent Number: 5,797,665

[45] Date of Patent: Aug. 25, 1998

[54] FILE HOLDERS WITH FOLDER RETENTION

[75] Inventor: Jack W. Jeter, Akron, Ohio

[73] Assignee: Jeter Systems Corporation, Akron, Ohio

[21] Appl. No.: 780,577

[22] Filed: Jan. 8, 1997

Related U.S. Application Data

[63] Continuation-in-part of Ser. No. 405,365, Mar. 16, 1995, abandoned, and Ser. No. 405,366, Mar. 16, 1995.

[51] Int. Cl.[6] ..... A47B 87/02

[52] U.S. Cl. ..... 312/107; 312/111; 312/257.1; 108/27

[58] Field of Search ..... 312/107, 111, 312/257.1; 108/91, 150, 153, 27, 32; 211/135, 188, 194, 11; 220/652

[56] References Cited

U.S. PATENT DOCUMENTS

| | | | |
|---|---|---|---|
| 1,221,948 | 4/1917 | Young | 312/107 |
| 1,627,084 | 5/1927 | Fritz | 312/107 |
| 1,648,277 | 11/1927 | Korb | 312/107 |
| 1,692,463 | 11/1928 | Merrin | 312/107 X |
| 1,849,659 | 3/1932 | Burks | 312/107 |
| 2,298,578 | 10/1942 | Madsen | 108/27 |
| 2,980,477 | 4/1961 | Hansen | 108/27 |
| 3,294,353 | 12/1966 | Rowe | 108/27 X |
| 4,331,335 | 5/1982 | Starkweather | 108/32 X |
| 4,606,170 | 8/1986 | Mendenhall | 108/27 |
| 5,332,611 | 7/1994 | Shanok et al. | 108/27 X |
| 5,551,352 | 9/1996 | Meier et al. | 108/27 |

FOREIGN PATENT DOCUMENTS

| | | | |
|---|---|---|---|
| 76130 | 7/1953 | Denmark | 312/257.1 |
| 685073 | 7/1930 | France | 312/107 |
| 1073916 | 9/1954 | France | 108/144 |
| 2160663 | 6/1973 | Germany | 312/257.1 |
| 2403198 | 9/1974 | Germany | 108/91 |
| 3310889 | 10/1983 | Germany | 312/111 |
| 2403 | 5/1901 | United Kingdom | 312/107 |

*Primary Examiner*—Peter M. Cuomo
*Assistant Examiner*—Rodney B. White
*Attorney, Agent, or Firm*—Renner, Kenner, Greive, Bobak, Taylor & Weber

[57] ABSTRACT

A file holder for holding a plurality of file folders, wherein a support surface and a plurality of perpendicularly extending side panels have a hemmed support edge and a hemmed panel edges, respectively. The hemmed support edge and the hemmed panel edges provide structural strength to the file holder while providing a file opening which has increased space for the easy insertion and extraction of file folder and a file holder with relatively smooth surfaces that do not catch or tear the file folders. The file holder also has a plurality of dividers which are secured to the support surface and a back wall and which provide additional structural support when a file holder is stacked on another file holder or other shelving. The file holders are constructed with attachment holes and nesting members so that multiple file holders can be stacked on one another. The support surface may also include a file retainer that is substantially perpendicular to the front edge of the file folder. The file retainer prevents the file folders inadvertently falling from the support surface by precluding linear of the file folders.

4 Claims, 5 Drawing Sheets

FILE HOLDERS WITH FOLDER RETENTION

CROSS-REFERENCE TO RELATED APPLICATIONS

This is a continuation-in-part of application Ser. Nos. 8/405,365, now abandoned, and 8/405,366, filed Mar. 16, 1995 for "Hemmed Edge File Holder" and "Dual-Slant File Holder," respectively.

TECHNICAL FIELD

The invention herein resides generally in the art of open faced file holders for holding a plurality of filing folders. More particularly, the present invention relates to an open faced file holder with hemmed surface edges and hemmed side edges to provide more clearance and prevent excessive wear on file folders as they are extracted and inserted. The present invention also relates to a dual-slant file holder that provides quick visual recognition of indicia on the file folder and facilitates the insertion and extraction of file folders. Specifically, the present invention also relates to the above file holders that employ an extending lip to prevent file folders from falling out of the file holders.

BACKGROUND ART

Various methods of holding file folders are well known. One common method of storing filing folders is to employ drawer-type filing cabinets. Where space is not a concern, front facing drawer-type filing cabinets are frequently used. Front facing filing cabinets allow a clerk to pull open the drawer and leaf through the file folders until the desired file is found. Where space is a concern, such as in a hallway or corridor, side facing drawer-type filing cabinets are employed. Side facing filing cabinets allow the clerk to open the drawer and access the file folder from its side or front depending upon how the file is stored in the drawer. However, use of drawer-type filing cabinets is inefficient in that the drawer must be pulled away from the cabinet in order to access the file folders. The drawers also add to the cost of such filing systems.

Open-face shelf filing systems have been developed in order to overcome the need for opening and closing a drawer-type filing cabinet and reduce the cost thereof. Typically, open-face shelf filing systems are constructed so that the file folders have exposed vertical edges. The clerk only has to approach the shelf filing system and locate the desired file folder. To assist in locating the desired file folder, the vertical edges of the file folders typically have color coded marking indicia attached thereto for easy identification. It is also known that the side panels of open-face shelf filing systems can be slanted at an angle so that the vertical edges of the file folders are more easily visualized. In order to provide the open face shelf filing systems with the required structural strength, it is well known to provide the shelves and side panels with right angle flanges. It is also well known that dividers can be vertically disposed on the shelves for the purpose of classifying groups of files in the filing system and to provide additional structural strength.

Although the open-face shelf filing system is effective for storing file folders, it is apparent that the current construction has several drawbacks. Primarily, the right angle flanges used to increase shelf strength reduce the amount of usable file folder space. Moreover, the right angle flanges overhang adjacent shelves so that the file folders on the adjacent shelves tend to catch and become worn as they are inserted or extracted. Another drawback of current open-face shelf filing systems is that the vertical dividers employed are often of a non-uniform construction from one divider to the next and therefore do not provide reliable structural support to adjacent shelves.

One alternative to front facing or side facing filing systems is the use of a slant file as disclosed in U.S. Pat. No. 3,737,046. This patent discloses an open-shelf filing system which has parallel end faces and partitions extending from front to rear at an angle of between 40° and 60°. The primary advantage of employing this slant file is that the dimension of the shelving from front to back is greatly reduced. As such, the filing system can be placed along corridor walls without significantly narrowing the corridor width. Additionally, the staggered position of the file folders on the slant file exposes the marking indicia to view so that a particular file is identified more easily. Although an improvement over the drawer-type filing cabinets and open-shelf filing systems, the prior art slant file still evidences problems with inserting the desired file because neighboring file folders must first be moved out of the way. Although the slant file reduces the depth of the filing system, it correspondingly increases the length of the shelves and wall space required to implement the system.

Another drawback of open-faced shelf filing systems is that file folders tend to fall out while other file folders are inserted or extracted. This is a common occurrence where the support surface that is holding the file folders is slanted or where the filing system is presented in a wheeled configuration with the file holders on wheels received within tracks. Access to the files in these wheeled systems require that an entire column of files be moved in order to access the appropriate file folder. When moving these wheeled file folders it will be appreciated that sudden stops or movements may cause file folders to spill onto the floor. This causes aggravation to the clerk and may also cause damage to the contents of the file folder. Additionally, the spilled contents of the file folder may be re-inserted in the wrong file folder causing aggravation at a later date.

Based upon the foregoing, it is evident that there is a need in the art for an open-face shelf filing system with low profile shelves and side panels which has the same structural strength as previous filing systems. There is also a need to provide a file holder with dividers that have consistent center-to-center spacing between supporting flanges so that the dividers provide supporting structural integrity to the filing system.

Based upon the foregoing, it is also evident that there is a need in the art for a dual-slant file holder that allows easy identification of marking indicia and for easy insertion and extraction of the file folder by exposing the top corners of the file folders. Furthermore, there is also a need to provide a dual-slant file holder which has the appearance of a regular open-shelf filing system, and does not have the extreme dimensional space loss that is created by the current single slant file systems. There is also a need to provide a dual-slant file holder which is configured such that the filing system is adapted for "fleeting" through the file folders as by sequential exposure of singular folders by deflecting said folders away from preceding folders by passing a thumb or finger across the outermost exposed edges of the folders.

Based upon the aforementioned needs, it will be appreciated that there is also a need to maintain and hold file folders within an open-faced shelf filing system as presented above, while maintaining the advantages of the present file holders. Additionally, there is a need to provide a file retention system that is removable when desired.

DISCLOSURE OF THE INVENTION

In light of the foregoing, it is a primary aspect of the present invention to provide an open-face file holder system which has shelves and side panels with hemmed edges.

Another aspect of the present invention is to provide a file holder with hemmed edges, wherein the edges of the shelves and side panels are hemmed upon themselves so as to provide structural strength to the shelving.

Still a further aspect of the present invention is to provide a file holder system with hemmed edge shelves and side panels that has increased usable space for the file folders received therein.

An additional aspect of the present invention is to provide a file holder system wherein the file folders received therein do not catch or tear on the hemmed edge shelves and side panels.

Yet an additional aspect of the present invention is to provide a file holder system, that has a plurality of dividers with equal center-to-center spaced flanges disposed on the shelves so as to provide additional strength to the file holder system.

In light of the foregoing, it is also another primary aspect of the present invention to provide a dual-slant file holder for supporting file folders.

Another aspect of the present invention is to provide a dual-slant file holder wherein the file folders have marking indicia disposed on their respective vertical edges which is easy to see.

Still a further aspect of the present invention is to provide a dual-slant file holder in which the file folders received therein are easy to insert and extract.

An additional aspect of the present invention is to provide a dual-slant file holder with a slanted support surface and a plurality of slanted support walls.

An additional aspect of the present invention is to provide a dual-slant file holder wherein the slanted supporting surface has a textured surface to increase its frictional coefficient so as to prevent file folders from slipping off of the surface.

Yet an additional aspect of the present invention is to provide a slanted support surface with a fabric strip disposed thereon so as to prevent file folders from slipping off of the surface.

Another aspect of the present invention is to provide a file holder system, as set forth above, with hemmed edges, wherein the hemmed edge presents a surface perpendicular to the support surface to prevent linear withdrawal movement of any one of the file folders retained thereon.

Still another aspect of the present invention is to provide a file holder system, as set forth above, wherein the hemmed edge has an upwardly extending lip that prevents linear withdrawal movement of the file folder.

Yet a further aspect of the present invention is to provide a file holder system, as set forth above, that has a removable clip body from which extends a lip that functions to preclude linear withdrawal movement of file folders supported by the file holder.

The foregoing and other aspects of the invention which shall become apparent as the detailed description proceeds are achieved by a file holder, comprising: a support surface capable of holding a plurality of the file folders; a plurality of panels carried by the support surface and substantially perpendicular thereto, the support surface and the plurality of panels forming a file folder opening for receiving the plurality of file folders; and a file retainer extending from the support surface which precludes linear withdrawal movement of any one of the plurality of file folders from the support surface.

The present invention also provides a file holder, comprising: a front face; a slanted support surface; a plurality of parallel side panels substantially perpendicular to the slanted support surface and slanted at an angle other than a right angle to the front face, wherein the slanted support surface and the plurality of parallel side panels form a file folder opening for receiving a plurality of file folders; and a file retainer extending from the slanted support surface which precludes linear withdrawal movement along the slanted support surface of any one of the plurality of file folders from the slanted support surface.

The present invention also provides a file retainer for preventing file folders from falling off a file holder shelf, comprising: a clip body having a pair of opposed ends and a pair of opposed edges, the clip body having a longitudinal slit joining the pair of opposed ends to the pair of opposed edges, the longitudinal slit received on a file holder shelf having a top and a bottom, one of the pair of opposed ends bearing on the top of the shelf and the other of the opposed ends bearing on the bottom of the shelf; and a lip extending from the clip body to preclude linear withdrawal movement of a file folder disposed on the top of the file holder shelf.

BEST MODE FOR CARRYING OUT THE INVENTION

Figure 1:
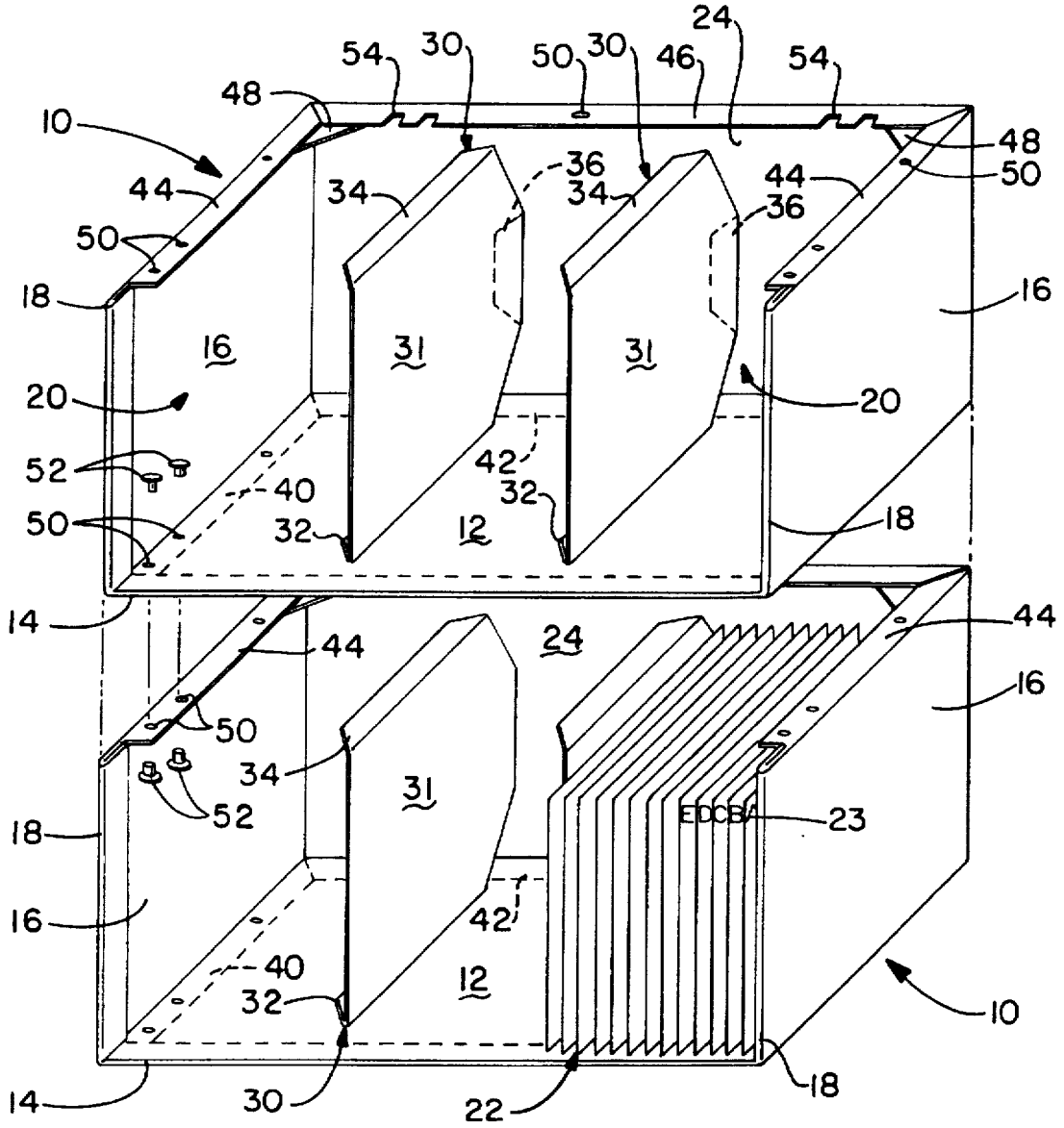
FIG. 1 is a perspective view of a file holder with hemmed edges holding a plurality of file folders and illustrating that the file holder is mateable with other file holders of similar, construction.

Referring now to the drawings and more particularly to FIG. 1, it can be seen that a file holder employed in conjunction with the present invention is designated generally by the numeral 10. Generally, the file holder 10 includes a support surface 12 which has a hemmed support edge 14 and a plurality of panels 16 which have hemmed panel edges 18. As will be described in further detail below, the file holder 10 with a hemmed support edge 14 and hemmed panel edges 18 provides a file holder which is structurally stable and provides increased space for inserting and extracting file folders. It will be appreciated that the file holder 10 is manufactured from a rigid material, such as sheet metal.

In particular, the file holder 10 has a support surface 12 that provides a level surface which can rest either on a floor or on a like file holder 10. The support surface 12 has a hemmed support edge 14 that provides increased structural strength to the support surface 12 so that it does not easily bend or deform. Substantially perpendicular to the support surface 12 are panels 16 which have hemmed panel edges 18. The hemmed panel edges 18 provide increased structural strength for the panels 16 in much the same manner as the hemmed support edge 14. The support surface 12 is carried by the panels 16 so that file folder openings 20 are created for receiving a plurality of file folders 22. The file folders 22 have marking indicia 23 on their exposed vertical edges. A back wall 24, which is perpendicular to both the support surface 12 and the panels 16, is integral with the panels 16 so as to provide a stopping surface for the file folders 22.

Figure 2:
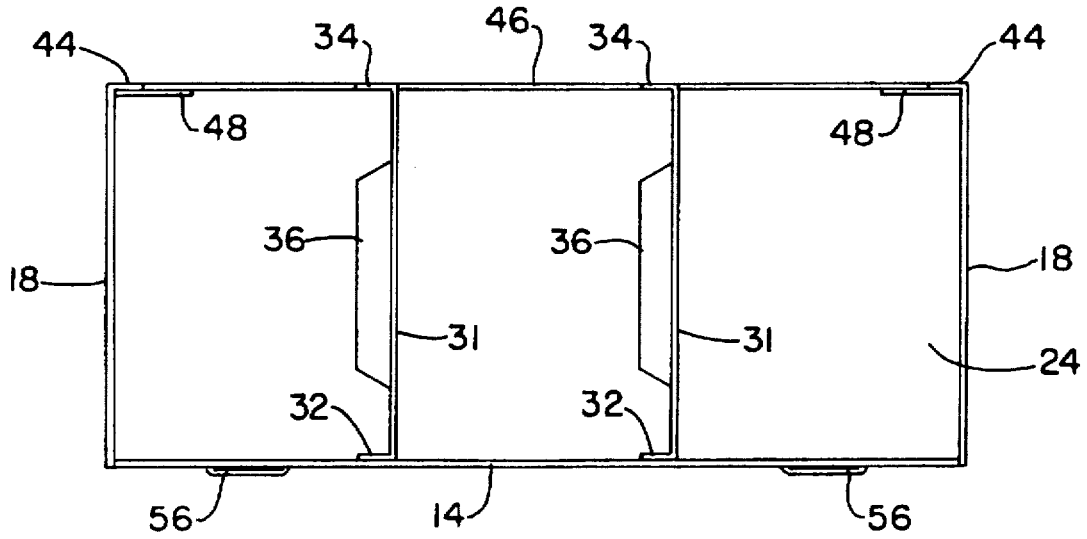
FIG. 2 is a front elevational view of a single file holder with hemmed edged shelves and side panels.

Referring now to FIGS. 1 and 2, it can be seen that a plurality of dividers 30 are carried and secured to the file holder 10 for laterally supporting and further classifying the file folders 22. Each divider 30 has a body 31 which has a predetermined center-to-center spacing between a perpendicularly extending support flange 32 and a perpendicularly extending top flange 34. The body 31 also has a perpendicularly extending wall flange 36. As those skilled in the art will appreciate, the support flange 32 is secured to the support surface 12 by any known means such as spot welding or by rivets. In much the same manner, the wall flange 36 is secured to the back wall 24. As will be discussed in further detail below, the top flange 34 is employed to support additional file holders stacked on the file holder 10.

The panels 16 and back wall 24, which in the preferred embodiment is a single piece of sheet metal, have a panel ledge 40 and a back ledge 42 respectively. The panel ledge 40 is substantially perpendicular to the panel 16 and extends inwardly. In a similar manner, the back ledge 42 is substantially perpendicular to the back wall 24 and extends inwardly. As those skilled in the art will appreciate, the support surface 12 is carried and secured to the panel ledges 40 and the back ledge 42.

The panels 16 and the back wall 24 also have a side attachment ledge 44 and a back attachment ledge 46, respectively. The side attachment ledge 44 is substantially perpendicular to the panels 16 and extends inwardly. In a similar manner, the back attachment ledge 46 is substantially perpendicular to the back wall 24 and also extends inwardly. Corner pieces 48 are employed to interconnect each end of the back attachment ledge 46 to the adjacent side attachment ledges 44. The attachment ledges 44 and 46, the panel ledge 40 and back ledge 42 have attachment holes 50. The aligned attachment holes 50 allow the panel ledge 40 to be secured to the attachment ledge 44 of a second file holder 10 by rivets 52 or the like. Likewise, the attachment holes 50 on the back ledge 42 are aligned with the attachment holes 50 on the attachment ledge 46.

As best seen in FIG. 2, to further assist in securing a file holder 10 to a like file holder 10 or other file holders, the attachment ledge 46 has nesting members or attachment notches 54 that are mateable with a nesting member or buckle 56 on the back ledge 42.

Figure 3:
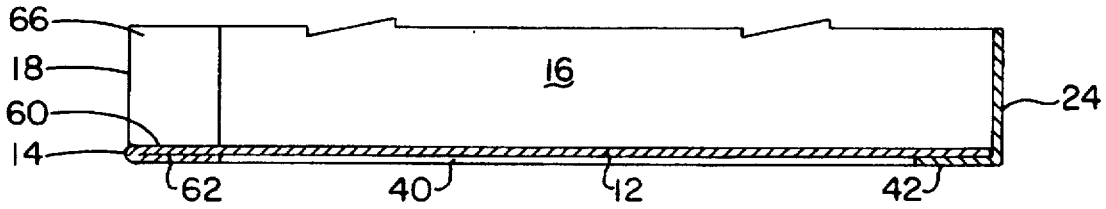
FIG. 3 is an enlarged transverse sectional view through the left end of a file holder with the upper portion thereof broken away.

Referring now to FIG. 3, an enlarged view of the hemmed support edge 14 is shown. As discussed earlier, the support surface 12 is supported and carried by the panel ledges 40. The hemmed support edge 14 has an outer support surface 60 opposite an inner support surface 62. Those skilled in the art will appreciate that the inner support surface 62 is hemmed or folded in such a manner that it bears upon itself. In the preferred embodiment, the hemmed support edge 14 is hemmed so it is disposed underneath the support surface 12. In other words, the plurality of file folders 22 rest on the support surface 12 opposite the hemmed support edge 14. It will be appreciated that the hemmed support edge 14 is of sufficient depth that file folders 22 supported by the second file holder 10, beneath the first file holder 10, will not catch or tear on the hemmed support edge 14.

Figure 4:
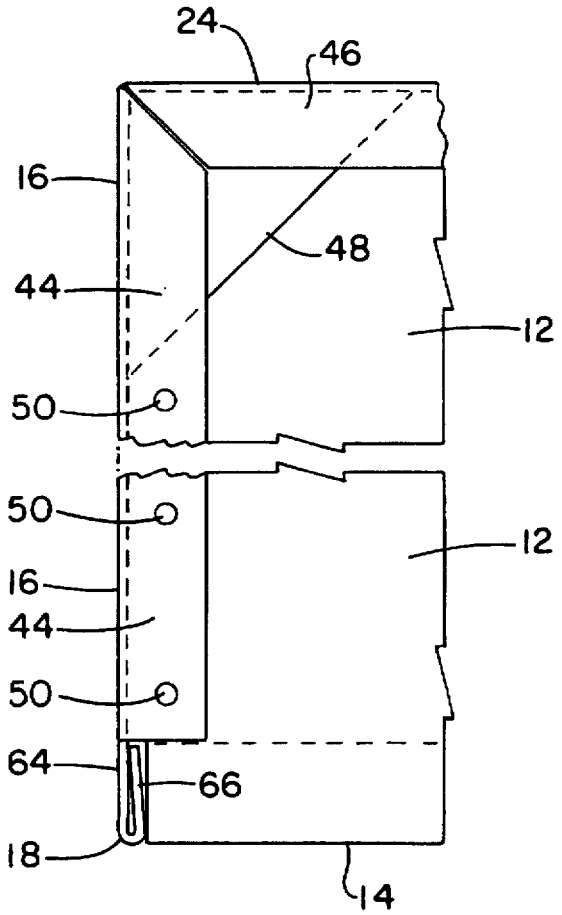
FIG. 4 is an enlarged top view of the left end of a file holder with portions being broken away.

As seen in FIG. 4, the hemmed panel edge 18 is constructed in a manner similar to the hemmed support edge 14. In particular, the panel 16 has an outer panel surface 64 opposite an inner panel surface 66 so that when the hemmed panel edge 18 is formed, the inner panel surface 66 bears upon itself. In the preferred embodiment, the hemmed panel edge 18 is directed inwardly within the file folder 10. Those skilled in the art will appreciate that the hemmed panel edge 18 is of sufficient depth that the sides of file folders 22, do not catch or tear on the panel edge 18 when extracted or inserted.

In actual use, the file holder 10 is placed on a level floor or other stable surface so that the file openings 20 face outwardly. A clerk can then easily insert and extract file folders 22 based on marking indicia 23 disposed thereon. It will be appreciated that since the file holder 10 has hemmed support edge 14 and hemmed panels edges 18 that the file folders 22 can not catch or tear as they are inserted and extracted.

Another feature in the use of the file holder 10 is that the nesting member 56, which is disposed on the underside of the back ledge 42, is mateable with the nesting member 54 disposed on the attachment ledge 46 of a second file holder 10. In particular, the underside of the back ledge 42 has a buckle 56 which is mateable with attachment notches 54 on the attachment ledge 46 of a second file holder 10. As such, multiple file holders 10 can be stacked on one another or configured in any manner desired by the clerk. To further enhance this stacking feature, the dividers 30 are constructed to support the underside of a support surface 12. In particular, the vertical divider 30 has a support flange 32 secured to the support surface 12 and a wall flange 36 secured to the back wall 24 in a manner well known in the art. Therefore, when the file holder 10 is stacked on top of a second file holder 10, the top flange 34 is placed in a bearing relationship with the underside of the support surface 12.

The body 31 of each of the dividers 30 has a highly accurate predetermined center-to-center spacing between the support flange 32 and the top flange 34 to allow for this effective stacking of the file holders 10. In the prior art, the dividers 30 were formed from blanks by bending the flanges 32, 34 to specific dimensions. Accordingly, the height of the body 31 was established by whatever material remained between the bends of the flanges. Thus, if the blank were oversized or undersized, the resultant body portion 31 would be similarly mis-sized and the height of the divider 30 would vary from its desired height. According to the instant invention, the body portion 31 is the controlling dimension of the divider 30, with the flanges 32, 34 being formed off of center-to-center measurements of the body portion 31. As a result, while the dimensions of the flanges 32, 34 may vary from divider to divider, the heights of the dividers are uniform and consistent.

Figure 5:
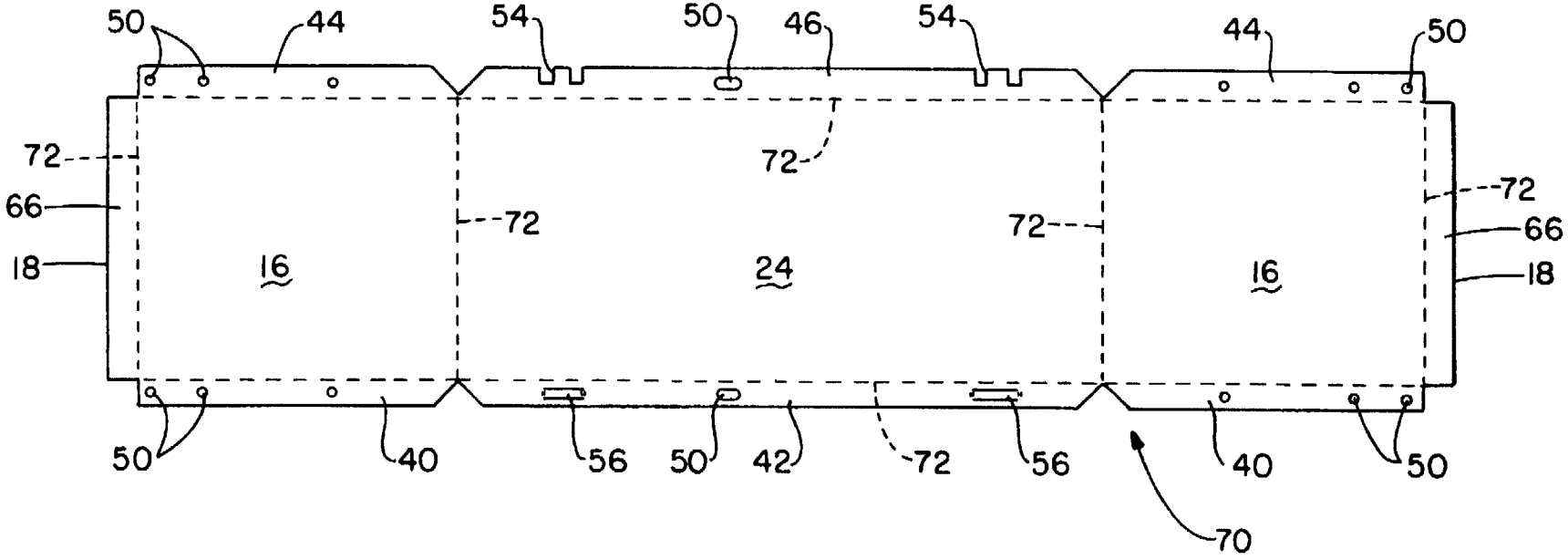
FIG. 5 is a plan view of a blank forming the side and backwall panels of a file holder.

In a similar manner, FIG. 5 shows a blank or primary member 70 that is used to form the panels 16 and the backwall 24 with an accurate and consistent center-to-center spacing between hemmed panel edges 18, between the attachment ledge 46 and the back ledge 42, between the panel ledges 40 and the attachment ledges 44, and between respective side panels 16. The blank 70 has a highly accurate predetermined center-to-center spacing between fold lines 72 which define the height and width of the back wall 24 and the side panels 16. As such, the exposed sides of the remaining material of the blank 70 are employed to form the hemmed edges 18, the panel ledges 40, the back ledge 42, the attachment ledges 44, and the attachment ledge 46. By employing center-to-center spacing to form the back wall 24 and the side panels 16, the height and width of the file holder 10 remains uniform and consistent to facilitate the stacking thereof.

As is well known in the art, the bending of a piece of sheet metal strengthens that sheet metal along that edge. Accordingly, the hemmed support edge 14 and the hemmed panel edge 18 strengthens the file holder 10 so that it can support the weight of other file holders and like folders.

From the above description, it should be apparent that the insertion and extraction of file folders 22 is greatly enhanced by the use of the file holder 10. Primarily, the reduced profile of the hemmed support edge 14 and the hemmed panel edges 18 provide increased space for the insertion and extraction of file folders 22 by a clerk employing the file holder 10. The low profile of the hemmed support edge 14 and hemmed panel edges 18 also provides a relatively smooth surface that does not catch any corner of a file folder 22. This is an advantage in that the file folder 22 is not exposed to the excessive wear and tear normally caused by shelving that has downwardly extending flanges.

It will be appreciated, that the low profile of the hemmed support edge 14 and the hemmed panel edges 18 provides a space savings from top to bottom and side to side. As such, this allows for the possibility of securing more file holders 10 to a wall and it also provides a more pleasing appearance over the normal flanged shelf construction.

A further advantage of the present file holder 10 is that it can be stacked on top of or side by side with additional file holders 10. This is accomplished by virtue of the mating features of the buckles 56 being receivable with the attachment notches 54. Multiple file holders 10 are secured to one another by employing the rivets 52 through the attachment holes 50 in a manner well known in the art. An additional advantage of the present invention is that the dividers 30 have a body 31 with highly accurate center-to-center spacing such that the top flange 34 contacts and supports the underside of a support surface 12 of a second file holder 10.

Yet another advantage is that the back 24 and the side panels 16 have accurate and consistent dimensional properties so that multiple file holders may be stacked with minimal waste of space.

Thus, it can be seen that the objects of the invention have been satisfied by the structure presented above. It should be apparent to those skilled in the art that the objects of the invention can be practiced for any size file holder and could be adapted for side panels that are vertical or in a slanted direction.

Figure 7:
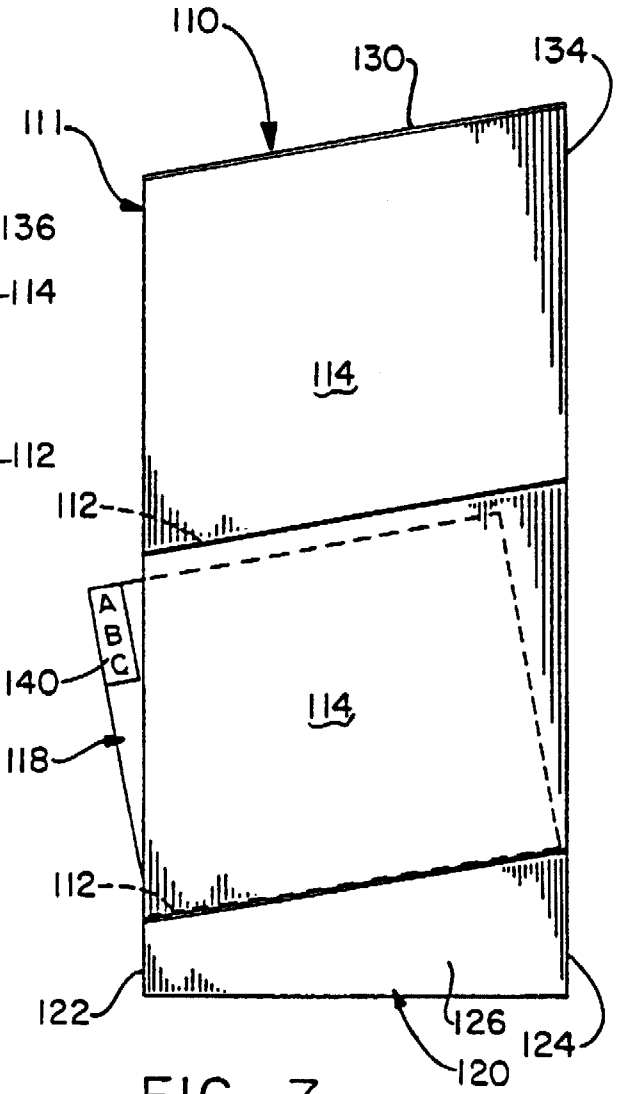
FIG. 7 is right side elevational view of the dual-slant file holder according to the present invention.
Figure 6:
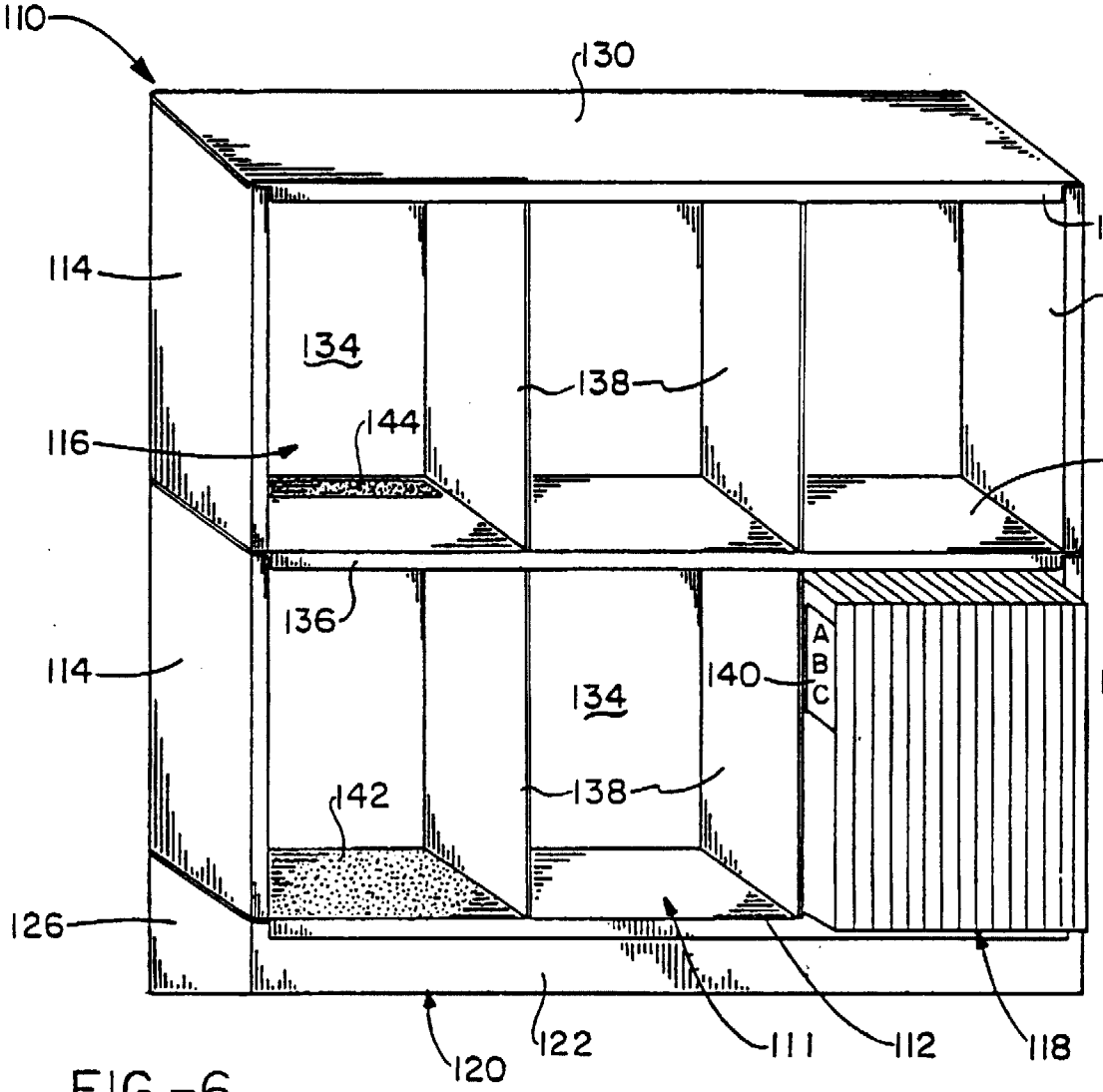
FIG. 6 is a front elevational view of a dual-slant file holder according to the present invention.

In another embodiment of a file holder employed in conjunction with the present invention as shown in FIGS. 6 and 7, it can be seen that a dual-slant file holder according to the present invention is designated by the numeral 110. Generally, the dual-slant file holder 110 includes an open front face 111, slanted support surfaces 112, and a pair of slanted parallel support walls or side panels 114 which are perpendicular to the slanted support surfaces 112. As will be described in further detail below, the slanted support surfaces 112 and the side panels 114 form a file opening 116 for receiving a plurality of file folders 118 in such a manner that they are easy to locate, extract and insert. It will be appreciated that the dual-slant file holder 110 may be constructed so that there is a single file opening 116 or it may be partitioned or compartmentalized as shown. Moreover, the dual-slant file holder 110 can be of modular construction such that several file holders can be secured together in either a stacked or in side by side relation as desired.

In particular, the dual-slant file holder 110 shown in FIGS. 6 and 7 has an open front 111 which is exposed to the person using the device. The lower one of the slanted support surfaces 112, which in the preferred embodiment are shaped in the form of an oblique parallelogram, is carried and supported by a base 120 such that the lower slanted support surface 112 is directed at an angle other than a right angle to the base 120. The base 120 is horizontally supported on a flat plane such as an office floor, bookshelf or other level surface. The base 120 includes a front wall 122 which is parallel with the front face 111, a back wall 124 which is parallel with the front wall 122, and a pair of sidewalls 126 which are trapezoidal in shape. Those skilled in the art will appreciate that the slant of the lower support surface 112 is established by the front wall 122 and the back wall 124 being of unequal heights. In other words, the front wall 122 is of a shorter height than the back wall 124 so that the lower support surface 112 is tilted at an angle other than a right angle to the plane on which the base 120 is supported. In the preferred embodiment, the lower slanted support surface 112 is directed downwardly from the back wall 124 to the front wall 122. It is within the scope of this invention that the slanted support surface 112 could be directed downwardly from the front wall 122 to the back wall 124.

The parallel side panels 114 are substantially perpendicular to the slanted support surface 112 and are also in the shape of an oblique parallelogram. Moreover, the side panels 114 are directed at an angle other than a right angle with respect to the front face 111. In the preferred embodiment, the side panels 114 are angularly directed when considered from the front to the back of the file holder 110. However, it is also within the scope of the present invention that the side panels 114 could be directed to the right with respect to the front face 111.

A cover or top 130 encloses and is carried by the plurality of side panels 114. As will be appreciated by those skilled in the art, the cover 130 is in a parallel plane with respect to the slanted support surfaces 112 so as to form the file openings 116 for receiving a plurality of file folders 118.

The dual-slant file holder 110 also has a back wall 134, which is parallel with the back wall 124 of the base 120 and in interconnection with the side panels 114 and the cover 130. A lip 136 may be defined on a front edge of the upper slanted support surfaces 112, as shown. Alternatively, it will be appreciated that the support surface 112 and the side panels 114 may be configured to present a hemmed edge as shown in FIGS. 1–5 to provide the advantages associated therewith. A plurality of slanted dividers 138 are in planes parallel to the parallel side panels 114 and are disposed therebetween to provide structural support to the dual-slant file holder 110. It will be appreciated by those skilled in the art that the vertical slanted dividers 138 are substantially perpendicular to the slanted support surfaces 112. Moreover, the slanted dividers 138 may be constructed in such a manner that they are insertable anywhere along the length of the slanted support surface 112 so as to hold the file folders 118 in any manner desired. The dividers 138 may also be extended fully between the upper and lower support surfaces 112, or the upper support surface 112 and the top 130 to provide structural support and integrity.

The file folders 118 have indicia 140 disposed on a vertical edge so that a particular file folder 118 is easily identifiable and can be retrieved and inserted into the proper location within the dual-slant file holder 110.

The slanted support surfaces 112 may also have modifications made thereto so that the file folders 118 do not easily slip or fall from their location within the dual-slant file holder 110. In particular, the slanted support surfaces 112 may have a textured surface 142 which increases the frictional coefficient thereof to prevent the plurality of file folders from slipping on such slanted support surfaces. Another method of retaining the file folders 118 within the dual-slant file holder 110 is to dispose a gripper surface 144, such as a piece of cloth or a portion of hook-and-loop material, on the slanted support surface 112 so as to prevent the file folders 118 from slipping.

In actual use, it can be seen that the dual-slant file holder 110 angularly directs the file folders 118 within the file opening 116 in two directions. First, the file folders 118 are directed inwardly and upwardly with respect to the base 120 on the slanted support surface 112. Secondly, the file folders 118 are angularly directed inwardly and toward the left with respect to the front face 111 by the side panels 114. It will be appreciated that the support surfaces 112 are carried or supported by the base 120, side panels 114 and partitions 138 such that the angle between the floor or other horizontal support surface and the slanted support surfaces 112 is between 5° and 40°. In the preferred embodiment, the angle between the floor and the slanted support surface 112 is about 10°. In a similar manner, the angle between the parallel side panels 114 and the plane of the front face 111 is between 5° and 40° and in the preferred embodiment is about 10°.

It will be appreciated then that the dual-slant file holder 110, which has about a 10° slant rearwardly and upwardly and about a 10° slant rearwardly and to the left, at first glance has the appearance of a regular open-face file holder. However, by slanting the support surfaces 112 and the side panels 114 several, distinct advantages are obtained over the normal open-face file holder.

As best seen in FIG. 7, the upper portion of the vertical edge of the file folder 118 extends outwardly from the front face 111. This allows a person facing the dual-slant file holder 110 to easily ascertain and see the marking indicia 140. In other words, the downward slant of the stored file folder 118 exposes the marking indicia 140 to more light than would a normal open-face file holder, and the directional slant to either the left or right exposes the marking indicia 140 to a broader spectrum of view for ease of readability. This is especially true when the marking indicia 140 is color coded in an easily recognizable fashion.

A further advantage of directing the file folders 118 in two directions is that the clerk filing the file folder 118 can take his or her thumb and/or fingers and "fleet" through the indicia markers 140 to easily see the indicia disposed thereon. In other words the clerk places his or her thumb on the edge of the file folder 118 and pushes it away to expose the marking indicia 140 until the file folder 118 deflects past the thumb and returns to its original position and the clerk's thumb rests on the adjacent file folder 118. As such, the clerk can quickly ascertain the location of the desired file folder 118. Another advantage of the dual-slant file holder 110 is in reinsertion of the file folders 118 into the file openings 116. Reinserting a file folder 118 within the file opening 116 requires only one hand to move the stored file folders 118 aside by directing the file folder 118 in a simultaneously downwardly and inwardly direction. This is in contrast to a normal vertical filing shelf which requires a strictly inward motion of the file folder such that is may be impeded by adjacent file folders. Thus, it will be appreciated by those skilled in the art that the dual-slant file folder 110, which directs the top corner of the file folders 118 to extend outwardly and downwardly from the front face 111, allows the "knifing" or reinsertion of the file folders 118 back into their proper position. A further advantage of the present invention is that the slanted shelves 136 and the slanted dividers 138 provide structural support to the dual-slant file holder 110 while classifying the file folders 118 as desired.

The dual-slant file holder 110 also provides two alternative embodiments. The first alternative embodiment provides for the textured surface 142 disposed on the slanted support surfaces 112. The textured surface 142 provides an increased frictional coefficient between the file folders 118 and the slanted support surfaces 112. As such, the file folders 118 are precluded from inadvertently slipping out of the file openings 116 and spilling onto the floor which supports the base 120. In a second alternative embodiment, a gripper surface 144 is secured to the slanted support surface 112. In a manner similar to the textured surface 142, the gripper surface 144 greatly increases the frictional coefficient between the file folders 118 and the slanted support surface 112. It will be appreciated by those skilled in the art that the gripper surface 144 could be a cloth-like material, a hook and loop fabric, or any other material on which a file folder does not easily move. It will also be appreciated that the gripper surface 144 may be selectively disposed on the slanted support surface 112 to achieve the desired combination of securing the file folder 118 within the dual-slant file holder 110 and for easily sliding the file folder into and out of the file opening 116.

Thus, it can be seen that the objects of the invention have been satisfied by the structure presented above. It should be apparent to those skilled in the art that the objects of the invention could be practiced with any size file folder 118 and that the dual-slant file holder 110 could be constructed in a modular fashion so that multiple file holders could be stacked upon one another or in adjoining side-by-side relation.

Figure 8:
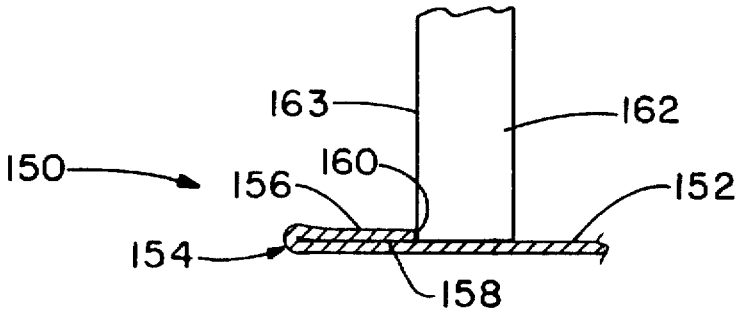
FIG. 8 is an enlarged transverse sectional view through the left end of a file holder with the upper portion thereof broken away and showing a file retainer.
Figure 9:
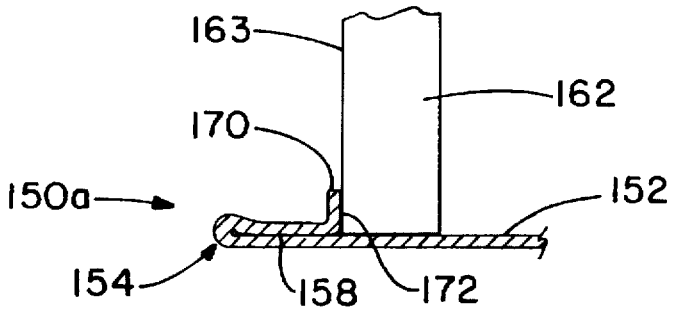
FIG. 9 is an enlarged transverse sectional view through the left end of a file holder with the upper portion thereof broken away showing an alternative file retainer.
Figure 10:
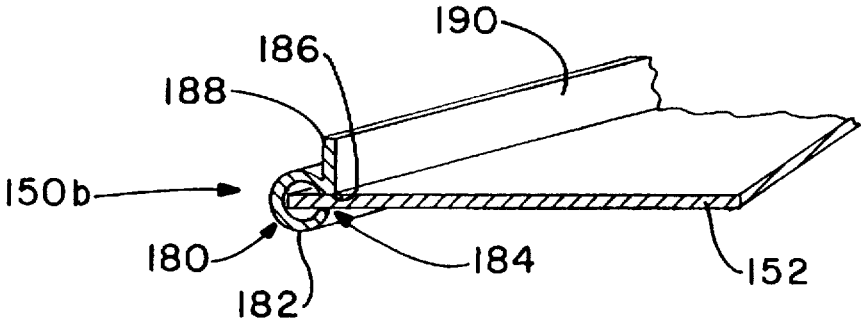
FIG. 10 is an enlarged perspective view of a file holder with a clip body received thereon.

Referring now to FIGS. 8–10, it can be seen that a file retention system is designated generally by the numeral 150. Generally, the file retention system 150 can be employed in either the hemmed edge file folder 10, the dual-slant file holder 110 or any other open-faced shelf filing system that is generally known in the art. Generally, the file retainer 150 functions to hold a plurality of file folders in place as the filing system is moved or to prevent inadvertent withdrawal of a file folder as adjacent file folders are inserted and removed. Specifically, the file retainer 150 precludes linear withdrawal movement of any one of the plurality of file folders from the open-faced shelf filing system. In other words, a clerk must first lift a file folder over the file retainer and then withdraw the file folder from the filing system. Although this adds an extra movement by the clerk, the file retention system 150 provides an overall time savings by preventing the clean-up of spilled file folder contents.

The file retainer 150 includes a support surface 152 and a hemmed support edge 154 which extends therefrom. The hemmed support edge 154 includes an edge portion 156 and an inner support surface 158 that bears upon itself. It will be appreciated that the inner support surface 158 is a continuation of the support surface 152. It will also be appreciated that the edge portion 156 includes a file retention edge 160 that is substantially perpendicular to the support surface 152. It has been found that by folding the edge portion 156 upwardly, the file retention edge 160 is in a plane parallel with a plurality of file folders 162 for retention thereof upon the support surface 152. In other words, the file folders 162 cannot be removed by applying a linear extraction force to a front edge 163 of the file folders 162. To remove the file folders 162 from the support surface 152, an upward force is first applied to the edge 163 and then a linear force is applied to withdraw the file folder. Referring now to FIG. 9, an alternative file retainer is designated generally by the numeral 150*a*. The file retainer 150*a* includes a lip 170 that extends upwardly from the edge portion 156. The lip 170 provides a file retention edge 172 that is greater in dimension than the thickness of the edge portion 156. This alternative embodiment presents a more substantial impediment to the file folders 162 dislodging from the support surface 152. It will be appreciated that the file retention edge 172 is substantially parallel with the front edge 163.

Yet another embodiment of a file retainer is shown in FIG. 10 and is generally designated by the numeral 150*b*. The file retainer or file retention clip 150*b* includes a clip body 180 that is a generally C-shaped or an arcuate member. Typically, the clip body 180 is manufactured out of a flexible polymeric material and is attached to the outer edge of a shelf. The clip body 180 includes a pair of opposed ends 182 having a longitudinal slit 184 therebetween along the entire length of the clip body 180. A pair of opposed edges 186 interconnect each opposed end 182. Those skilled in the art will appreciate that the distance between each opposed edge 186 is equal to or less than the thickness of the support surface 152 or hemmed support edge 154. Those skilled in the art will appreciate that the flexible nature of the clip body 180 provides a compressive force with the opposed ends 182 against the top and bottom surfaces of the shelf upon which it is received. Extending upwardly from one of the opposed edges 186 is a lip 188 which has a file retention edge 190. As in the previous embodiments, the file retention edge 190 is substantially parallel with the front edge of the file folders 162. As in the previous embodiments, the lip 188 precludes linear withdrawal movement of a file folder disposed on the top surface of the file folder shelf.

In use, the clip body 180 is extended substantially along the entire length of a file holder shelf to preclude linear withdrawal movement of any file folder. The opposed edges 186 are spread apart to allow the longitudinal slit 184 to be received on the support surface 152 or hemmed support edge 154. Since the width of the longitudinal slit 184 is equal to or less than the thickness of the support shelf 152, the opposed edges 186 exert a compressive force upon the top and bottom of the support shelf. Accordingly, slight applications of force to the lip 188 are insufficient to disengage the file retention clip 150*b* from the support surface 152. It will also be appreciated that due to the polymeric material employed in the manufacture of the clip body 180 that the file retention clip 150*b* is ideal for retro-fitting existing open-faced shelf filing systems. Of course, other flexible materials could be employed to manufacture the file retention clip 150*b*.

From the above description of the file retainers 150, 150*a*, 150*b*, it should be apparent that the retention of file folders is greatly enhanced. Primarily, the file retention edges are disposed in a plane substantially parallel with the front or leading edge of the file folders preclude their linear withdrawal from the supporting shelf. The file retainers presented can be placed on shelves that are substantially horizontal or slightly inclined. Moreover, the file retainers presented allow for the movement of mobile open-face filing systems without fear of inadvertently dislodging file folders.

Thus, it can be seen that the objects of the invention have been satisfied by the structure presented above. It should be apparent to those skilled in the art that the objects of the invention can be practiced for any size file folder and could be adapted to any thickness of support shelf.

While the preferred embodiment of the invention has been presented and described in detail, it will be understood that the invention is not limited thereto or thereby. Accordingly, for an appreciation of the true scope and breadth of the invention, reference should be made to the following claims.

What is claimed is:

1. A file holder, comprising:

a support surface for holding a plurality of file folders;

a plurality of panels carried by said support surface and substantially perpendicular thereto, said support surface and said plurality of panels forming a file folder opening for receiving the plurality of file folders; and a file retainer integrally extending from said support surface which precludes linear withdrawal movement of any one of said plurality of file folders from said support surface, said file retainer formed by a hemmed support edge at a front edge of said support surface, said hemmed support edge having an inner support surface that is a coplanar continuation of said support surface, said hemmed support edge having an edge portion of said support surface folded directly back onto itself at a top side of said support surface, wherein said hemmed support edge has an outer support surface substantially parallel to and in planar engagement with said inner support surface, said file retainer further comprising a file retention edge at an end of said hemmed support edge, said file retention edge being substantially perpendicular with said support surface and substantially parallel with a front edge of the plurality of file folders, wherein said file retention edge is dimensionally less than said hemmed support edge.

2. The file holder according to claim 1, wherein said file retention edge comprises a lip extending from said hemmed support edge, said lip having a file retention edge which is substantially perpendicular with said support surface and substantially parallel with a front edge the plurality of file folders.

3. A file holder, comprising:

a front face;

a slanted support surface;

a plurality of parallel side panels substantially perpendicular to said slanted support surface and slanted at an angle other than a right angle to said front face, wherein said slanted support surface and said plurality of parallel side panels form a file folder opening for receiving a plurality of file folders; and a file retainer integrally extending from said slated support surface which precludes linear withdrawal movement along said slanted support surface of any one of said plurality of file folders from said slanted support surface, said file retainer formed by a hemmed support edge at a front edge of said slanted support surface, said hemmed support edge having an inner support surface that is a coplanar continuation of said slanted support surface, said hemmed support edge having an integral edge portion of said slanted support surface folded directly back onto itself at a top side of said slanted support surface, wherein said hemmed support edge has an outer support surface substantially parallel to and in planar engagement with said inner support surface, said file retainer further comprising a file retention edge at an end of said hemmed support edge, said file retention edge being substantially perpendicular with said slanted support surface and substantially parallel with a front edge of the plurality of file folders, wherein said file retention edge is dimensionally less than said hemmed support edge.

4. The file holder according to claim 3, wherein said file retention edge comprises a lip extending from said hemmed support edge, said lip having a file retention edge which is substantially perpendicular with said slanted support surface and substantially parallel with a front edge the plurality of file folders.

* * * * *